US006408862B1

(12) United States Patent
van Rooyen

(10) Patent No.: US 6,408,862 B1
(45) Date of Patent: Jun. 25, 2002

(54) CENTRIFUGAL PAINT ROLLER CLEANER

(76) Inventor: Roland H van Rooyen, 16 Bridgewater Road, Bridgewater Estates, Somerset West 7130 (ZA)

( * ) Notice: Subject to any disclaimer, the term of this patent is extended or adjusted under 35 U.S.C. 154(b) by 0 days.

(21) Appl. No.: 09/560,792

(22) Filed: Apr. 28, 2000

(51) Int. Cl.[7] ..... B08B 3/02

(52) U.S. Cl. ..... 134/138; 134/172; 134/200; 134/900

(58) Field of Search ..... 134/137, 138, 134/900, 200, 172; 68/213

(56) References Cited

U.S. PATENT DOCUMENTS

| | | | | |
|---|---|---|---|---|
| 2,831,488 | A | * | 4/1958 | Anderson |
| 3,037,516 | A | * | 6/1962 | Leach |
| 3,075,534 | A | * | 1/1963 | Habostad |
| 3,126,899 | A | * | 3/1964 | Caywood |
| 3,139,891 | A | * | 7/1964 | Faustman |
| 3,422,828 | A | * | 1/1969 | Dommer |
| 3,428,060 | A | | 2/1969 | Spivey |
| 3,587,599 | A | * | 6/1971 | Bywater |
| 2,407,578 | A | | 9/1974 | Frankreich |
| 3,873,364 | A | * | 3/1975 | Smith |
| 4,142,540 | A | * | 3/1979 | Vegiard |
| 4,311,158 | A | | 1/1982 | Harvey |
| 4,402,333 | A | * | 9/1983 | Frizzel et al. |
| 4,832,066 | A | | 5/1989 | Shipman |
| 5,005,598 | A | | 4/1991 | Hodgdon |
| 5,050,626 | A | | 9/1991 | Brockage et al. |
| D330,101 | S | | 10/1992 | Weiss |
| 5,163,459 | A | | 11/1992 | Bailey |
| D340,327 | S | | 10/1993 | Alderete |
| 5,363,869 | A | | 11/1994 | McDowell |
| 5,402,808 | A | | 4/1995 | Wallis et al. |
| 5,413,133 | A | | 5/1995 | Russell |
| 5,487,399 | A | | 1/1996 | Hannah |
| 5,626,158 | A | | 5/1997 | Gratopp |
| 5,651,381 | A | * | 7/1997 | Balouchian |
| 5,839,459 | A | * | 11/1998 | Bisby |

* cited by examiner

*Primary Examiner*—Frankie L. Stinson
(74) *Attorney, Agent, or Firm*—Michael I. Kroll

(57) ABSTRACT

A centrifugal paint roller cleaner is provided wherein a used paint roller brush with fresh paint on it is rotatably secured within a cylindrical housing member and liquid is introduced into the housing member as a high energy single jet spray via an injector assembly that slides within an aperture that runs longitudinally along the length of the aforementioned housing member. The injector assembly swivels radially within the guiding passage to adjust the angle at which the high energy single jet single spray strikes the roller brush thus allowing the operator to regulate the axial rotation of the roller brush and the impact of the jet spray striking the paint absorbed to the nap of the roller brush. The axial rotation of the roller brush creates centrifugal force that serves to expel the loosened paint and water from the nap of the brush and into the fluid traveling within the area between the outer surface of the brush and the interior wall of the housing. The circumferential surfaces of the outer brush and interior wall of the housing member are concentric and provide for corresponding movement of liquid. Deflectors which extend angularly and longitudinally from the interior wall disturb the laminar flow and redirect the liquid back towards the outer surface of the brush and away from the apertures located within the housing member to enhance both the cleaning and propulsive properties of the circulating liquid while rendering the operation splash proof.

23 Claims, 14 Drawing Sheets

CENTRIFUGAL PAINT ROLLER CLEANER

BACKGROUND OF THE INVENTION

1. Field of the Invention

The present invention relates generally to paint roller cleaners and, more specifically, to a centrifugal paint roller cleaner wherein a used paint roller brush with water soluble paint on it is rotatably secured within a cylindrical housing member and a liquid cleaning agent is introduced into the housing member as a high energy single jet spray via an injector assembly that slides within an aperture that runs longitudinally along the length of the aforementioned housing member. The jet spray contacts the roller brush at an appropriate angle to encourage axial rotation of the roller brush and also impacts paint absorbed to the nap of the roller brush. The axial rotation of the roller brush creates centrifugal force which serves to expel the loosened paint and water from the nap of the brush and into the fluid traveling within the area between the outer surface of the brush and the interior wall of the housing. The circumferential surfaces of the outer brush and interior wall of the housing member are concentric and provide for corresponding movement of liquid. Deflectors, which extend angularly and longitudinally from the interior wall disturb the laminar flow and redirect the liquid back towards the outer surface of the brush to enhance both the cleaning and propulsive properties of the circulating liquid. The deflectors direct the fluid flow away from the apertures in the housing member (paint roller frame keyway and guiding passage) thus rendering the operation of the device splash-proof.

2. Description of the Prior Art

There are other paint roller cleaning devices designed for cleaning paint roller brushes in a neat, thorough manner. Typical of these is U.S. Pat. No. 3,428,060 issued to D. K. Spivey on Feb. 18, 1969.

Another patent was issued to Jerry J. Harvey on Jan. 19, 1982 as U.S. Pat. No. 4,311,158. Yet another U.S. Pat. No. 5,363,869 was issued to James McDowell on Nov. 15, 1994, and still yet another was issued on May 9, 1995 to Frank A. Russell as U.S. Pat. No. 5,413,133.

Another patent was issued to Dale A. Hannah on Jan. 30, 1996 as U.S. Pat. No. 5,487,399. A German Patent No. 2,407,578 was issued to Claude Detraz on Feb. 16, 1974.

U.S. Pat. Number 3,428,060

Inventor: Donald K. Spivey

Issued: Feb. 18 1969

The article cleaner housing cover and floor, journal a rotatable mount for an article, for instance a paint roller. The shaft of the article mount extends down through the floor and has an impeller secured to it. An inlet fluid conduit divides and supplies a spray of fluid against the article and a stream of fluid against the impeller to rotate the article.

U.S. Pat. No. 4,311,158

Inventor: Jerry J. Harvey

Issued: Jan. 19, 1982

A washer/dryer for paint rollers comprises a bucket-like container having pivotally-mounted inside a normally horizontal paint-roller spindle-shaft assembly, including outward resilient supports of a length less than a standard paint roller, to leave the ends of a roller mounted thereon open. An elongated water manifold, fed by a diverter valve, supplies water through primary spray heads to clean the outer side of the roller, and to secondary spray heads, axially outward of the roller and directed substantially parallel to the spindle axis, for cleaning the open ends of the roller. Water is also directed by a jet nozzle onto a turbine coupled for rotation with the paint-roller support; by operation of the diverter valve, water may be supplied to at least the spray heads for washing, to only the jet nozzle for spin drying, or to neither to terminate the wash/dry cycle.

U.S. Pat. No. 5,363,869

Inventor: James McDowell

Issued: Nov. 15, 1994

A roller cleaning assembly for cleaning water-soluble paint from a paint roller cover has two major components, namely an enclosure and a spray jet component. The enclosure has a rigid sidewall, preferably of rectangular cross-section, open at the bottom to permit free drainage and has a top wall with a central round opening of sufficient diameter to accommodate the roller cover. A u-shaped channel can grip the neck portion of the roller handle. The jet component is biased by a spring-like interference fit in the interior of the enclosure. A jet component has an inlet tube with a female fitting to attach to a source of water, and first and second riser pipes that rise from the inlet tube and which contain jet outlets that are spaced at intervals. The riser pipes direct jets of water and the roller cover to dislodge paint from the nap and to impart a spin to the roller. A bracket can be employed to mount the enclosure on a tank or bucket.

U.S. Pat. No. 5,413,133

Inventor: Frank A. Russell

Issued: May 9, 1995

A paint roller cleaning device includes a housing covered with a cover to hold the cylindrical brush of the paint roller on the inside, a spray tube received inside the housing and controlled to eject water onto the cylindrical brush of the paint roller causing the cylindrical brush washed or causing it turned to shake off water.

U.S. Pat. No. 5,487,399

Inventor: Dale A. Hannah

Issued: Jan. 30, 1996

A hollow tubular housing is provided having a freely rotatable support frame for holding a paint roller pad while cleaning. The housing is closed at one end and includes a series of openings down one side. A movable spray-tube is provided on the outside of the housing and includes a series of spray jets which correspond to the openings to spray water into the housing. The movability of the spray tube allows the user to change the direction of the water spray before or during cleaning in order to vary the speed and/or direction of the rotating roller pad inside. A second spray tube having a series of spray-openings therein is fixedly provided as the center shaft of the rotating internal support frame. A closable valve on the outside spray tube allows the user to adjust the flow of water to the sprayers. A specially formed gapped end piece is provided in the support frame to allow water from the inside spray tube to escape.

While these roller brush cleaners may be suitable for the purposes for which they were designed, they would not be as suitable for the purposes of the present invention, as hereinafter described.

SUMMARY OF THE PRESENT INVENTION

The present invention relates generally to paint roller cleaning devices and, more specifically, to a centrifugal paint roller cleaning device wherein a used paint roller brush with fresh paint on it is rotatably secured within a cylindrical housing member and a liquid cleaning agent is introduced into the housing member as a high energy single jet spray via an injector assembly which slides within an elongated aperture that runs longitudinally along the length of the aforementioned housing member.

A primary objective of the present invention is to provide a centrifugal roller brush cleaning device that will overcome the shortcomings of prior art devices.

Another object of the present invention is to provide a centrifugal roller brush cleaning device that allows the user to contain and control the flow and over spray of a liquid cleaning agent as it is being sprayed onto a roller brush that is rotatably secured within a substantially enclosed cylindrical housing member.

A further object of the present invention is to provide a centrifugal roller brush cleaning device that rotatably maintains a roller brush within a housing member having an inlet means for introducing a liquid cleaning agent and an egress means to permit drainage of the same liquid cleaning agent in a controlled manner.

A yet further object of the present invention is to provide a centrifugal roller brush cleaning device wherein the inlet means is a single injector assembly that is slidably maintained within an elongated aperture extending lengthwise along one side of the housing member to permit a high energy single jet spray to be applied to the entire length of the roller brush therein.

A still further object of the present invention is to provide a centrifugal roller brush cleaning device wherein the injector assembly has a normally-shut spring loaded integral valve that restrains flow of the liquid cleaning agent into the housing member until the operator pushes the injector valve into the open position.

A yet further object of the present invention is to provide a centrifugal roller brush cleaning device whereby the high energy single jet spray strikes the roller brush in a manner that results in the axial rotation of the roller brush thereby expelling waste material and liquid absorbed to the nap. The injector assembly can also swivel radially within the guiding passage to regulate the rotational speed of the roller brush.

Still another object of the present invention is to provide a centrifugal roller brush cleaning device having deflector projections protruding from the interior wall of the housing member to direct the fluid flow away from the apertures in the housing member (paint roller frame keyway and guiding passage) thus rendering the operation of the device splash-proof.

Another object of the present invention is to provide a centrifugal roller brush cleaning device having deflector projections protruding from the interior wall of the housing member to disrupt the laminar flow of the liquid and redirect it towards the roller brush as it flows in a descending spiral in the area between the spinning roller brush and the stationary housing member, thereby further adding rotational momentum to the spinning paint roller brush.

Another object of the present invention is to provide a centrifugal roller brush cleaning device that is substantially perpendicular to the base surface when in use and having a superior end that has a removable cap and an inferior end with a series of ejector apertures and drainage slots to allow drainage of the liquid cleaning agent and guide the drained waste away from the user.

Another object of the present invention is to provide a centrifugal roller brush cleaning device having means for adjustably securing and cleaning roller brushes of varying lengths and diameters therein while still on the roller handle frame or when independent from the roller handle frame.

Additional objects of the present invention will appear as the description proceeds.

The present invention overcomes the shortcomings of the prior art by providing a centrifugal paint roller cleaner wherein a used paint roller brush with fresh paint on it is rotatably secured within a cylindrical housing member and liquid is introduced into the housing member as a high energy single jet spray via an injector assembly that slides within an aperture that runs longitudinally along the length of the aforementioned housing member. The injector assembly swivels radially within the guiding passage to adjust the angle at which the high energy single jet spray strikes the roller brush thus allowing the operator to regulate the axial rotation of the roller brush and the impact of the jet spray striking the paint absorbed to the nap of the roller brush. The axial rotation of the roller brush creates centrifugal force which serves to expel the loosened paint and water from the nap of the brush and into the fluid traveling within the area between the outer surface of the brush and the interior wall of the housing. The circumferential surfaces of the outer brush and interior wall of the housing member are concentric and provide for corresponding movement of liquid. Deflectors which extend angularly and longitudinally from the interior wall disturb the laminar flow and redirect the liquid back towards the outer surface of the brush and away from the apertures located within the housing member to enhance both the cleaning and propulsive properties of the circulating liquid while rendering the operation splash proof.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is a perspective view of the present invention in use; shown is the operator using a first hand to hold the centrifugal paint roller cleaner in place against a base surface and controlling the longitudinal movement of the injector assembly with a second hand. The second hand also adjusts the angle of the high energy single jet stream into the housing assembly by simply swiveling the injector assembly thereby controlling the radial spin of the roller brush. The entire roller assembly is installed and retained by the removable end cap with roller frame access slot.

FIG. 2 is a perspective view of the present invention; shown is the male quick connect portion of the injector assembly which slides longitudinally along a ridged guiding passage. The ridged guiding passage provides access to the interior of the housing member through an elongated aperture in the housing member. The removable end cap and the housing member have mated keyways to accept and retain the roller frame arm. The opposing end has a lower compartment separated from the roller compartment by a disc with ejector apertures in a semicircular configuration to allow passage of effluence between the two compartments and to guide the flow down the solid wall of the lower compartment so the resulting turbulence propels the liquid through the slotted drain recesses on the opposing wall of the lower compartment wall. The clamping screw assembly is positioned within a threaded bushing centrally located in the separation disc and adjusts to accommodate different lengths and diameters of roller brushes.

FIG. 3 is an exploded perspective view of the present invention ready for use with a roller brush and roller frame assembly; shown is the housing member with the end cap, clamping screw and injector assembly removed. The end cap serves as a stop for the injector assembly as it travels along the ridged guiding passage thus permitting the removal of the injector assembly once the end cap is separated from the housing member. There is a slotted roller frame keyway extending from the lip of the end cap sidewall and a channel to accept the armature of a roller frame assembly that is perpendicular to the keyway spanning along the interior side of the top plate of the end cap and terminating in a central portion of the top plate. The roller brush and roller frame assembly are shown in phantom line.

FIG. 4 is an exploded perspective view of the present invention ready for use with a roller brush and spindle adapter bearing interface; shown is the housing member with the end cap, clamping screw and injector assembly removed. The end cap serves as a stop for the injector assembly as it travels along the ridged guiding passage thus permitting the removal of the injector assembly once the end cap is separated from the housing member. The end cap also provides a spindle bearing interface that is recessed to receive the spindle of one of the spindle adapters that are placed in both ends of the roller brush to be cleaned. When both spindle adapters are in place the roller could be inserted into the housing member with the spindle of one of the spindle adapters fitting into a spindle bearing interface recess located on the threaded end of the clamping screw. Once the end cap is on and the end cap spindle bearing interface recess is mated with the opposing spindle adapter's spindle, the clamping screw can be tightened to assure that the roller brush is centrally secured within the housing member but can spin freely.

FIG. 5 is a perspective view of the present invention being prepared for operation; shown is a roller brush and roller frame assembly being placed into the housing member and the retaining channel inside the end cap ready to accept the roller frame assembly's peripheral armature that is parallel to the roller frame assembly's handle. The injector assembly has been inserted into the guiding passage, while the clamping screw has been screwed into the threaded bushing.

FIG. 6 is a perspective view of the present invention with a roller brush and frame assembly inserted into the housing member and rotatably secured by the end cap and the clamping screw.

FIG. 7 is a perspective view of the present invention in use; shown is a roller brush and frame assembly inserted into the housing member and rotatably secured by the end cap and the clamping screw. A hose leading to a pressurized liquid cleaning agent supply is connected to the injector assembly by means of a 360 degree rotatable quick connect coupling. The integral valve inside the injector assembly is open and forcing a single jet spray to strike the peripheral, longitudinal edge of the roller brush to break up waste material in the roller brush nap and provide a means for orbital propulsion of the roller brush.

FIG. 8 is a bottom view of the present invention in use; shown is the flow of the liquid cleaning agent as it is injected into the housing member. The liquid cleaning agent is introduced into the housing member as a high energy single jet spray via an injector assembly that slides within an aperture that runs longitudinally along the length of the aforementioned housing member. The axial rotation of the roller brush creates centrifugal force which serves to expel the loosened paint and water from the nap of the brush and into the fluid traveling within the area between the outer surface of the brush and the interior wall of the housing. The circumferential surfaces of the outer brush and interior wall of the housing member are concentric and provide for corresponding movement of liquid. Deflectors, which extend angularly and longitudinally from the interior wall disturb the laminar flow and redirect the liquid away from the apertures in the housing member and back towards the outer surface of the brush to enhance both the cleaning and propulsive properties of the circulating liquid.

Figure 13:
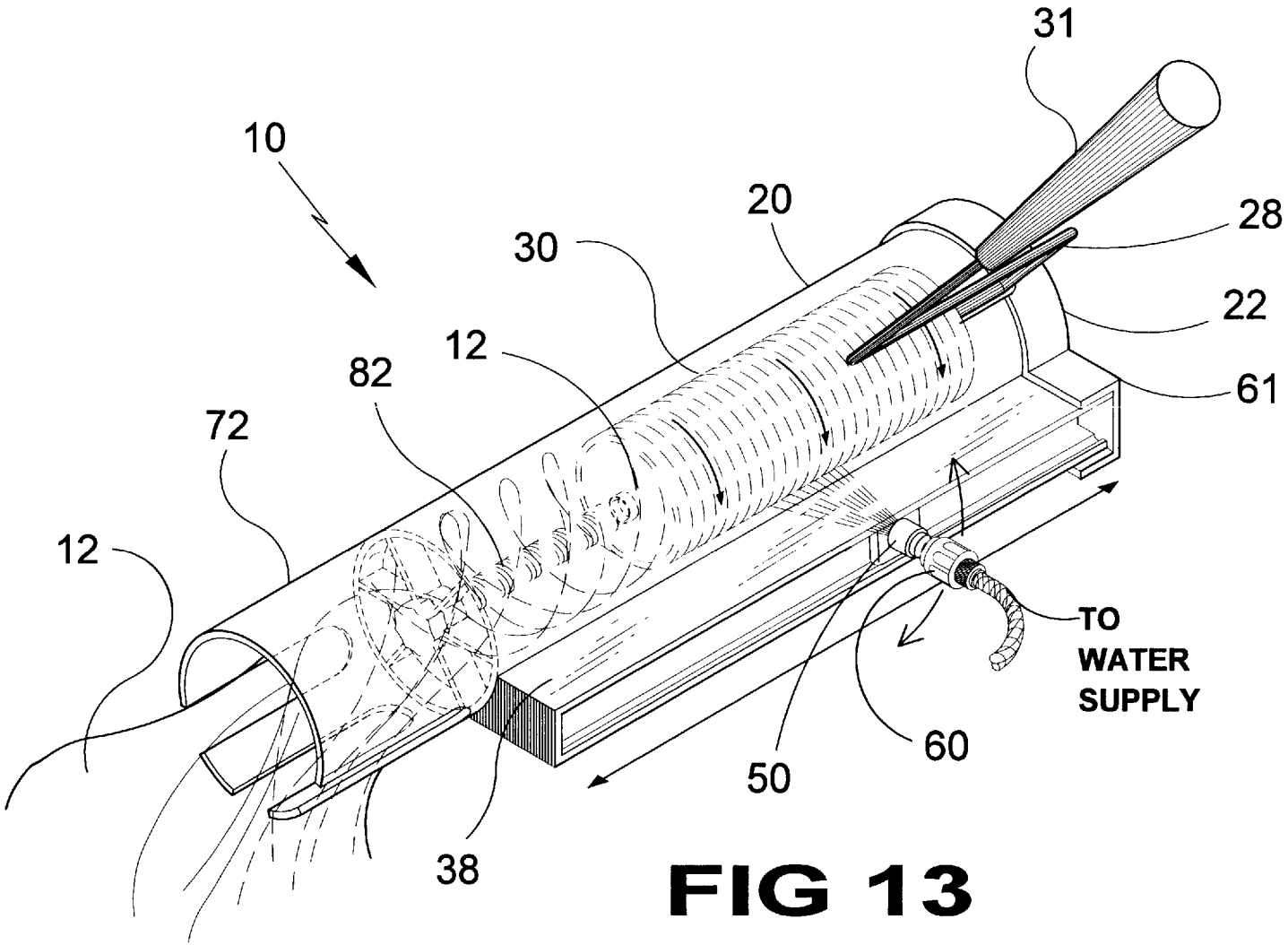
Figure 14:
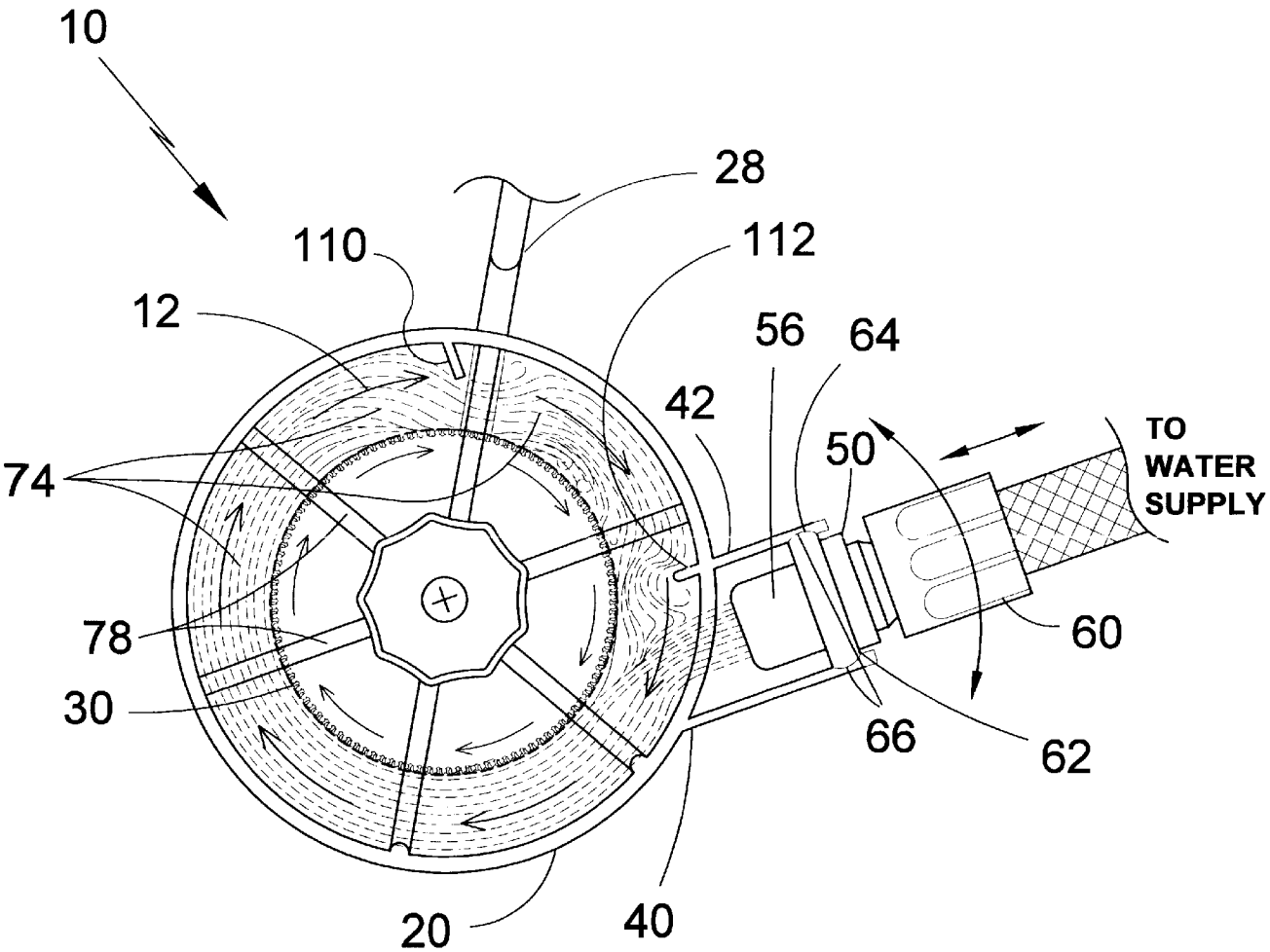

FIG. 13 is a perspective view of a variation of the present invention in use; shown is a roller brush and frame assembly inserted into the housing member and rotatably secured by the end cap and the clamping screw. A hose leading to a pressurized liquid cleaning agent supply is connected to the injector assembly by means of a 360 degree rotatable quick connect coupling. The integral valve inside the injector assembly is open and forcing a single jet spray to strike the peripheral, longitudinal edge of the roller brush to break up waste material in the roller brush nap and provide a means for orbital propulsion of the roller brush. The injector assembly can swivel radially to allow the operator to adjust the angle that the high-energy single jet spray strikes the roller brush thus allowing the operator to control the rotational speed of the roller brush. This is accomplished by a different injector assembly/guiding passage interface, as shown in FIG. 14. The liquid cleaning agent travels in a downward spiral and drains through the ejector apertures and drain recesses in the lower compartment.

FIG. 14 is a bottom view of a variation of the present invention in use, depicting the injector assembly curved surface and guiding passage side indention's allowing both longitudinal and rotational movement of the injector assembly within the guiding passage. The single jet spray contacts the roller brush at an angle controlled by the operator to encourage axial rotation of the roller brush and also impacts paint absorbed to the nap of the roller brush.

DESCRIPTION OF THE REFERENCED NUMERALS

Turning now descriptively to the drawings, in which similar reference characters denote similar elements throughout the several views, the Figures illustrate the centrifugal paint roller cleaner of the present invention. With regard the reference numerals used, the following numbering is used throughout the various drawing figures.

10 centrifugal paint roller cleaner of the present invention
12 fluid and waste
20 housing member cylinder
22 end cap
24 housing member keyway
26 end cap keyway
28 paint roller frame arm
29 paint roller brush mandrel
30 paint roller brush
31 paint roller frame handle
32 retaining channel
34 retaining channel parallel sides
36 housing member slot
38 guiding passage
40 guiding passage first side
42 guiding passage second side
44 guiding passage first side ridge
46 guiding passage second side ridge
48 guiding passage third side
50 injector assembly
52 injector assembly flange
54 injector assembly flange
56 injector nozzle
57 injector valve stem
58 injector assembly actuator
60 quick coupling
61 end cap extension
62 guiding passage first side indention
64 guiding passage second side indention
66 injector assembly curved surface
70 disc
72 lower compartment
74 drainage apertures
76 drainage slots
78 struts
80 threaded bushing
82 clamping screw
84 paint roller brush mandrel fastener
86 clamping screw mandrel fastener receptacle
87 clamping screw spindle bearing recess
90 spindle adapter
92 spindle adapter base
94 spindle adapter base reduced diameters portion
96 paint roller brush open ends
98 spindle adapter spindle portion
100 end cap spindle bearing recess
110 deflector
112 deflector

DETAILED DESCRIPTION OF THE PREFERRED EMBODIMENT

Turning now descriptively to the drawings, in which similar reference characters denote similar elements throughout the several views, FIGS. 1 through 14 illustrate the centrifugal paint roller cleaner of the present invention indicated generally by the numeral 10.

Figure 1:
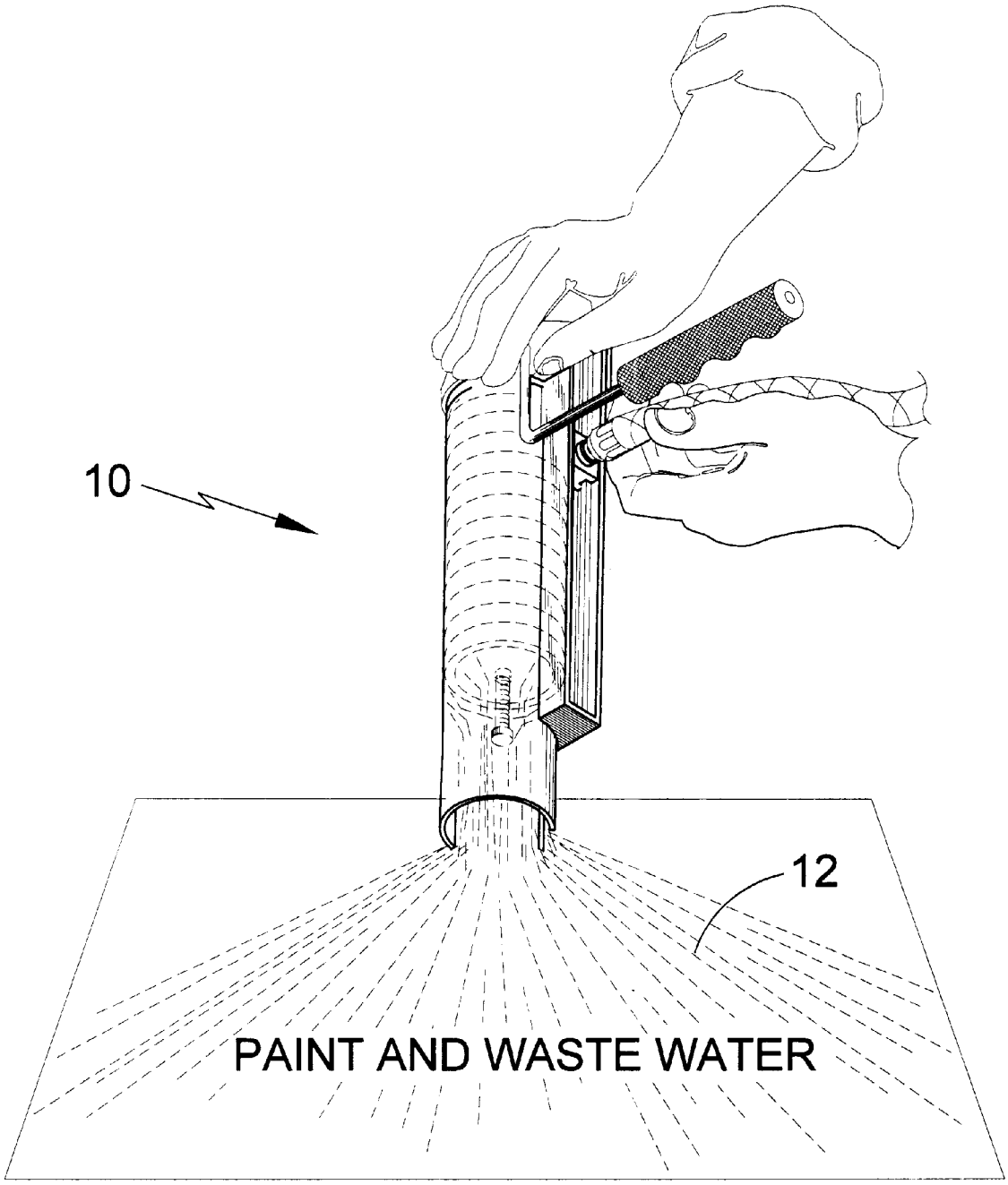
Figure 2:
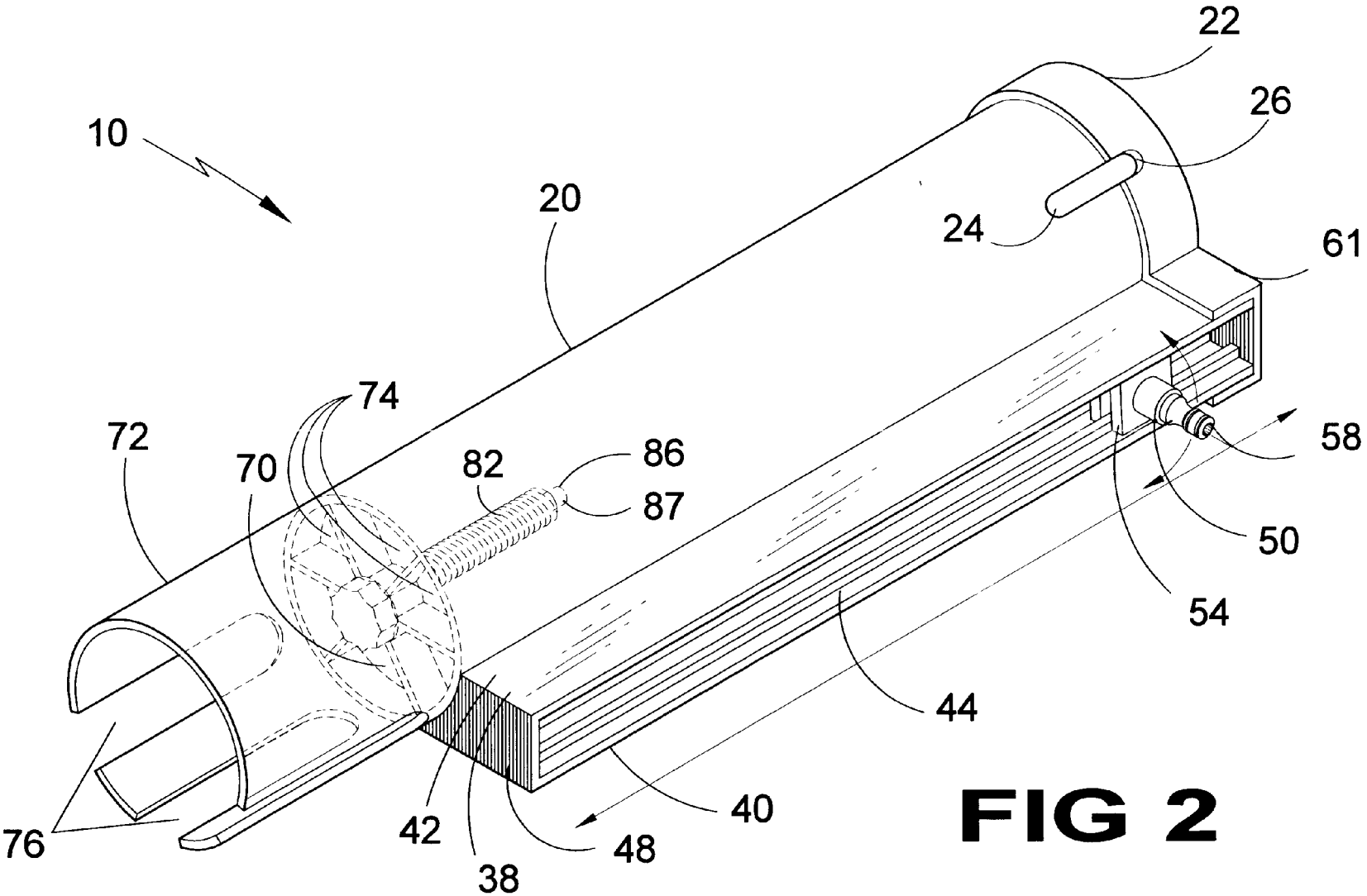

The fluid 12 handled by the device 10, enters in the form of water, or other cleansing fluid, and is discharged along with the paint and other waste, as shown in FIG. 1, which also depicts the device in use.

FIGS. 2 through 14 depict further detail and the operation of the device 10. The device 10 includes a housing member 20 and an end cap 22 that closes one end of the housing member 20. A housing member keyway 24 and an end cap keyway 26 are alignable and sized to allow passage of the paint roller frame arm 28. The paint roller frame arm 28 extends, with paint roller frame mandrel 29 rotatably attached, into the housing member 20, through the aligned keyways 24,26, such that the roller brush 30 is mounted concentrically within the housing member 20. The paint roller frame handle 31 is excluded from the housing member 20. As the paint roller frame arm 28 enters the housing member 20, it is closely received by a retaining channel 32 which positions the paint roller frame arm 28 for axial alignment with the housing member 20. The retaining channel 32 secures the paint roller frame arm 28 on the end cap side, while the paint roller brush mandrel fastener 84 locates on the clamping screw mandrel fastener receptacle 86. In another embodiment, the parallel retaining channel sides 34 are spaced so as to grasp the paint roller frame arm 28 without further support or assistance.

Figure 8:
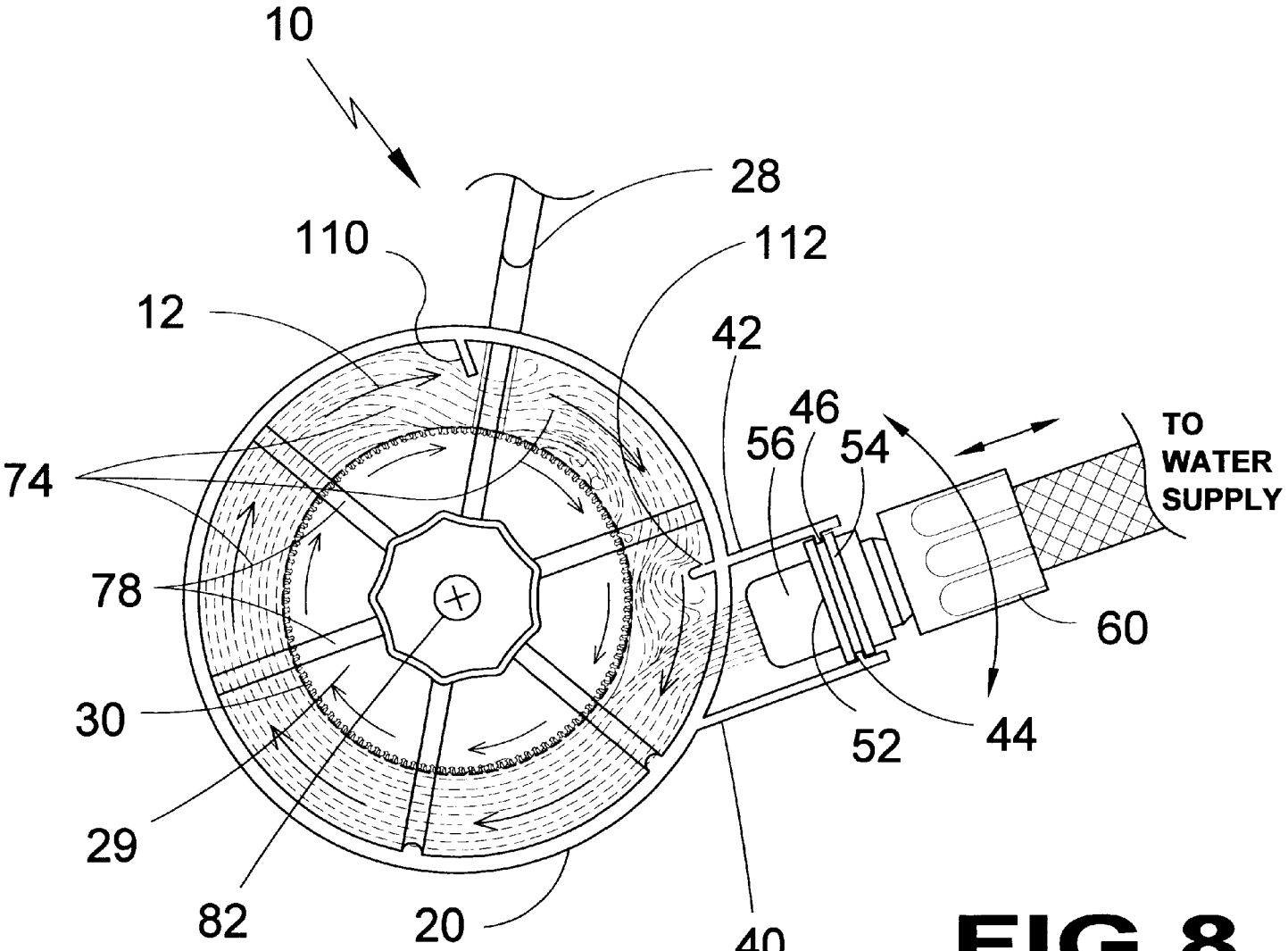
Figure 9:
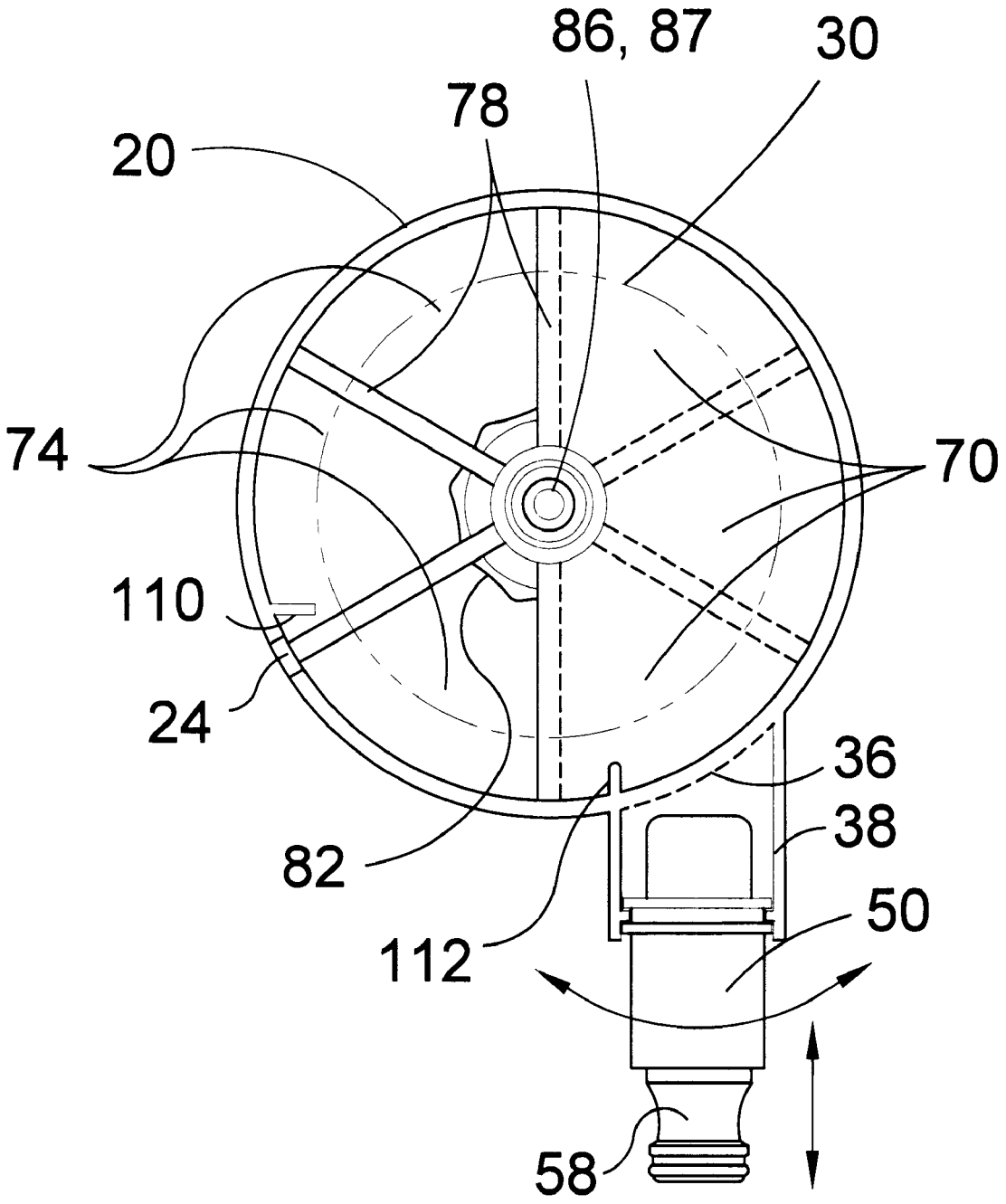
FIG. 9 is a top view of the present invention with the end cap removed showing the housing member slot in front of the injector nozzle.
Figure 10:
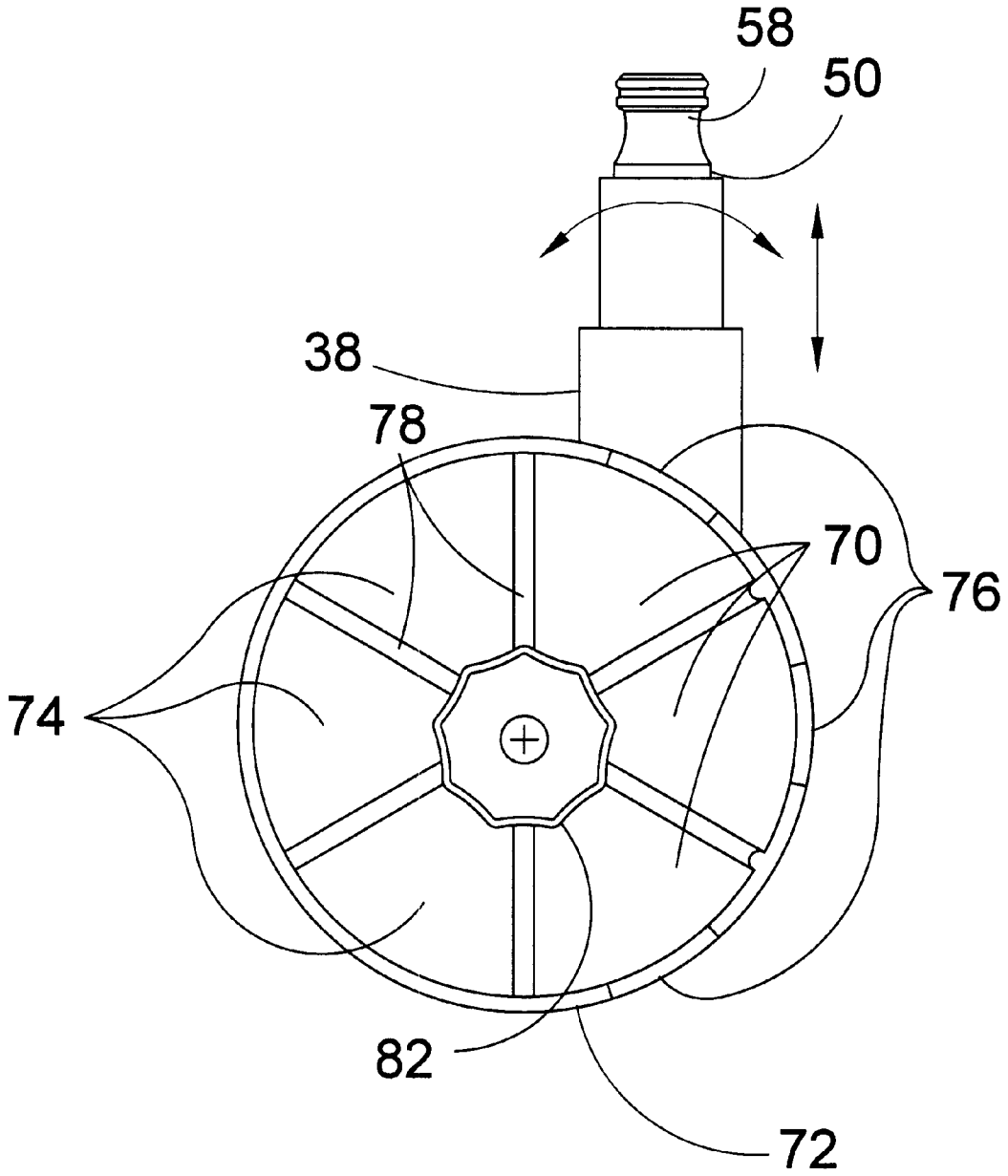
FIG. 10 is a bottom view of the present invention indicating the layout of the disc, its supporting struts and adjacent drainage apertures as well as the drainage slots in the housing member.
Figure 11:
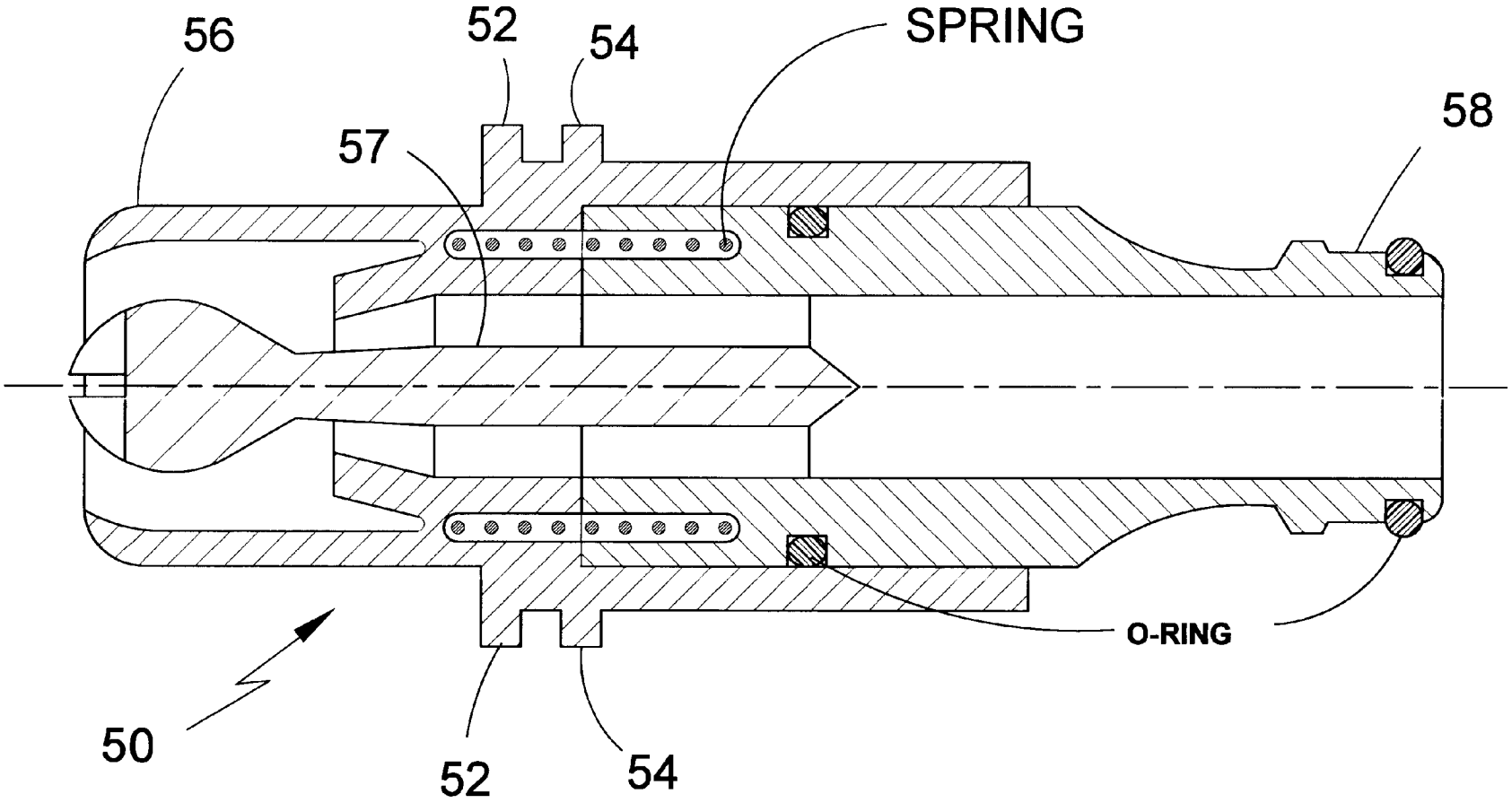
FIG. 11 is a cross-sectional side view of the injector assembly with integral valve opened due to the actuator having been pushed in. The injector assembly has a normally-closed spring-loaded integral valve to restrain flow of the liquid cleaning agent into the housing member when not in use.
Figure 12:
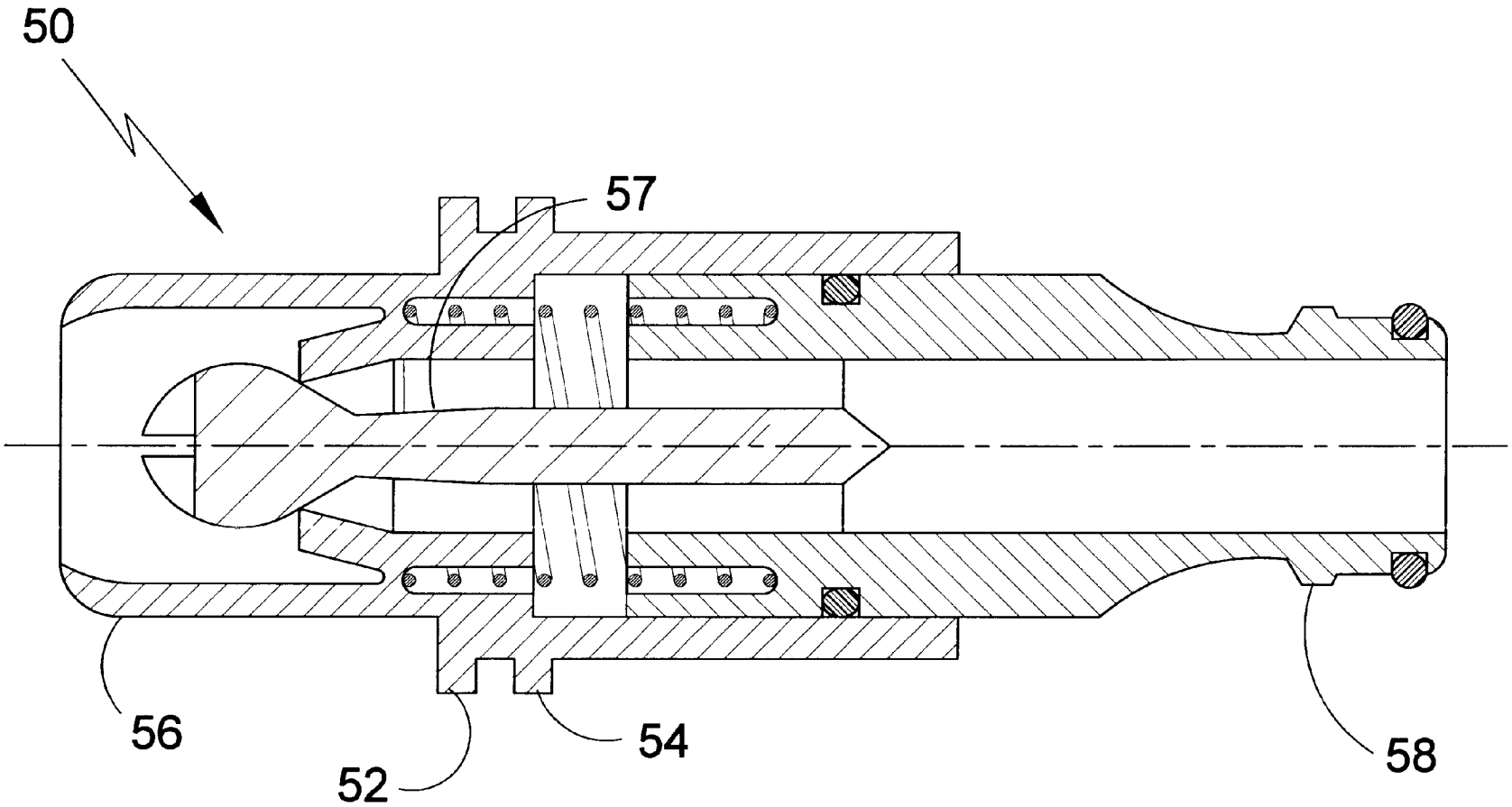
FIG. 12 is a cross-sectional side view of the injector assembly with integral valve closed due to the actuator having been released. The injector assembly has an integral valve to control the spread of t he single jet stream and to restrain flow of the liquid cleaning agent into the housing member when necessary.

The housing member 20 has a slot 36 as shown in FIG. 9 , that is positioned adjacent a guiding passage 38, such that fluid 12 may enter into the housing member 20 through the guiding passage 38 and slot 36. In the embodiment shown in FIGS. 1 through 12, the guiding passage 38 has a first side 40 and a second side 42, each side being attached to the housing member 20. Each of the guiding passage sides 40,42 has a ridge 44,46, respectively. This configuration receives an injector assembly 50. The injector assembly 50 has two parallel flanges 52,54 that are spaced to loosely receive ridges 44,46 when the injector assembly 50 is placed within the guiding passage 38, as particularly depicted in FIGS. 2 through 9. This allows the injector assembly 50 to slide along the length of the guiding passage 38, with the injector assembly nozzle 56 being guided to the housing member slot 36, such that the jetted fluid 12 enters the housing member 20 through the slot 36 and strikes the roller brush 30 at varying angles, as depicted in FIGS. 8 and 9. Such angle variations allows regulation of roller brush 30 rotation speed. The injector assembly 50 has an actuator end 58 that is adapted to receive a typical quick coupling 60. In one embodiment, the injector assembly 50 includes an on-off valve, the operation of which is depicted in FIGS. 11–12. The injector assembly actuator end 58 is pushed in to open and released to close.

The guiding passage 38 has an additional side 48 to prevent the injector assembly 50 from exiting the guiding passage 38. Such exit is also prevented, at the other end of the guiding passage 38, by an extension 61 of the end cap 22, which walls off the guiding passage 38 when the end cap 22 is placed on the housing member 20.

Another embodiment is depicted in FIGS. 13–14, which includes a guiding passage 38 with sides 40,42 that have indentions 62,64, respectively for receiving the curved surface 66 of the injector assembly 50. This configuration allows the rotation of the injector assembly 50, such that the fluid 12 strikes the roller brush 30, at varying angles. Such angle variation allows regulation of roller brush 30 rotation speed. In other embodiments the guiding passage sides 40,42 are made of a resilient material, allowing the operator to vary the angle at which the fluid 12 strikes the roller brush 30 by slightly bending such sides 40,42 as the injector assembly 50 is grasped and manipulated.

Figure 3:
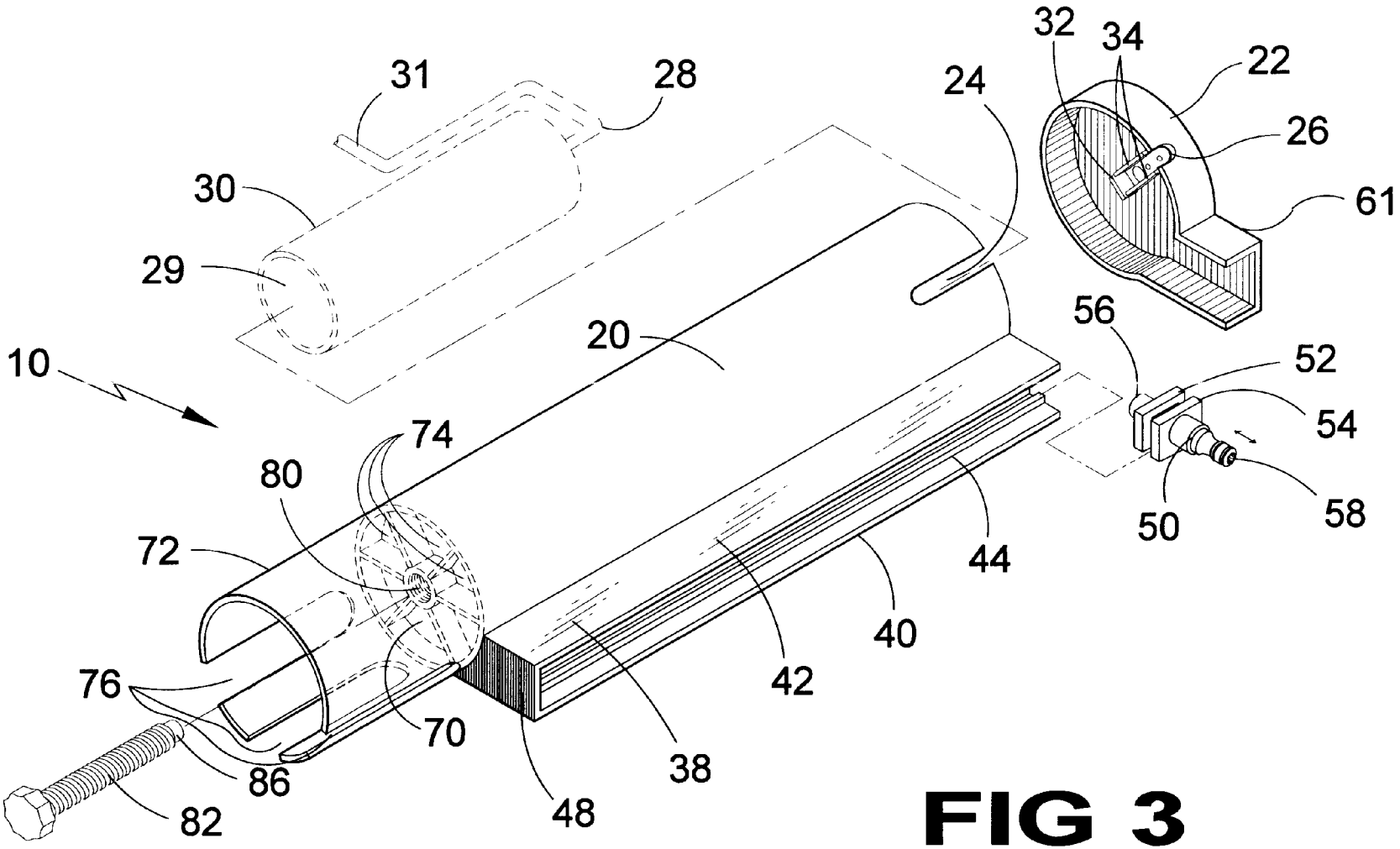

A disc 70 is affixed to the housing member 20, forming a lower compartment 72, as depicted in FIG. 3. Drainage apertures 74 are located in one half of the disc 70, which directs discharged fluid 12 against the lower compartment 72, along which the fluid 12 continues its radial movement until it encounters lower compartment drainage slots 76. The disc 70 has a threaded bushing 80 for receiving clamping screw 82. The disc 70 is supported by an equally spaced array of struts 78 which also centers the threaded bushing 80.

Figure 5:
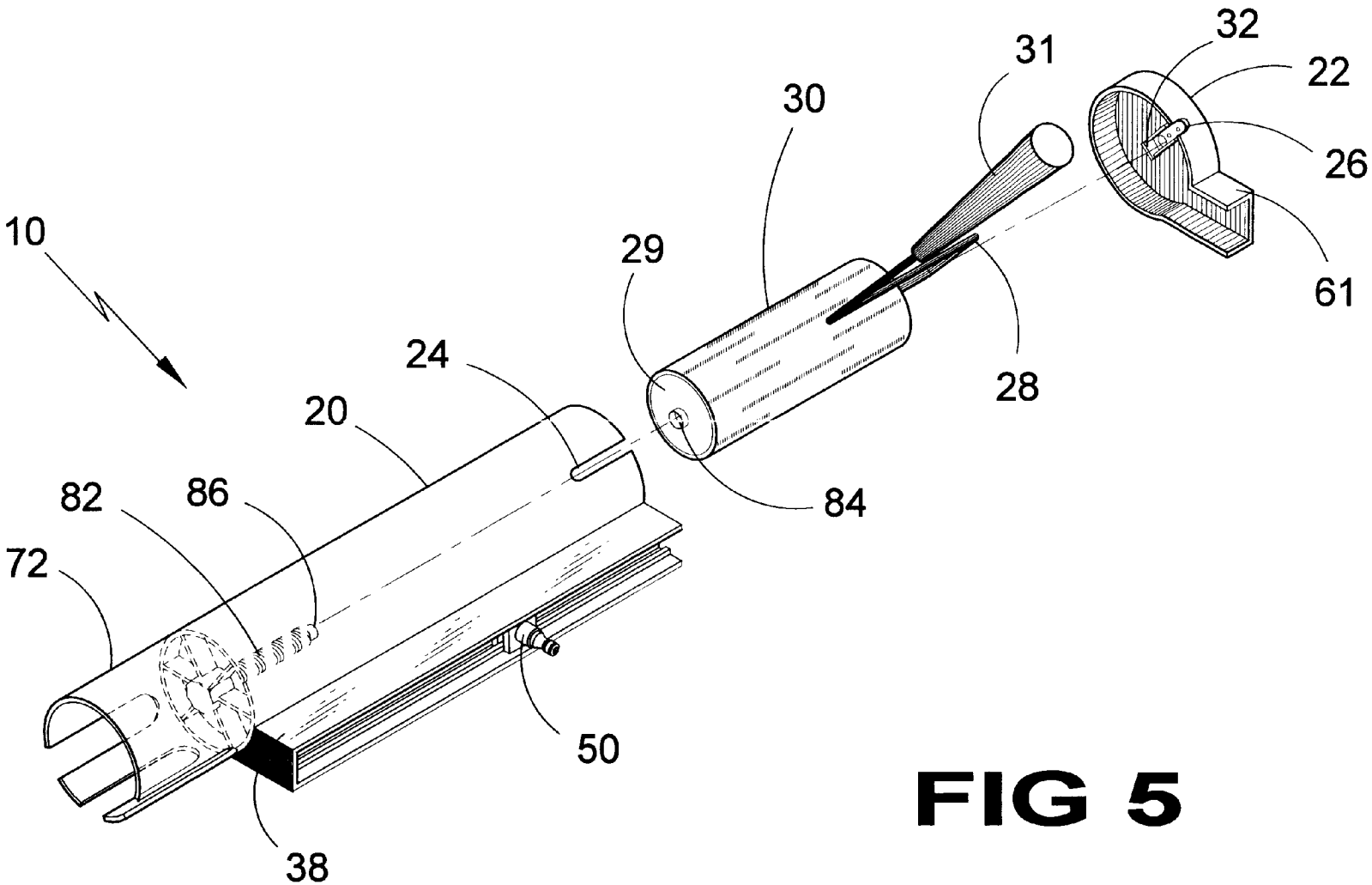
Figure 6:
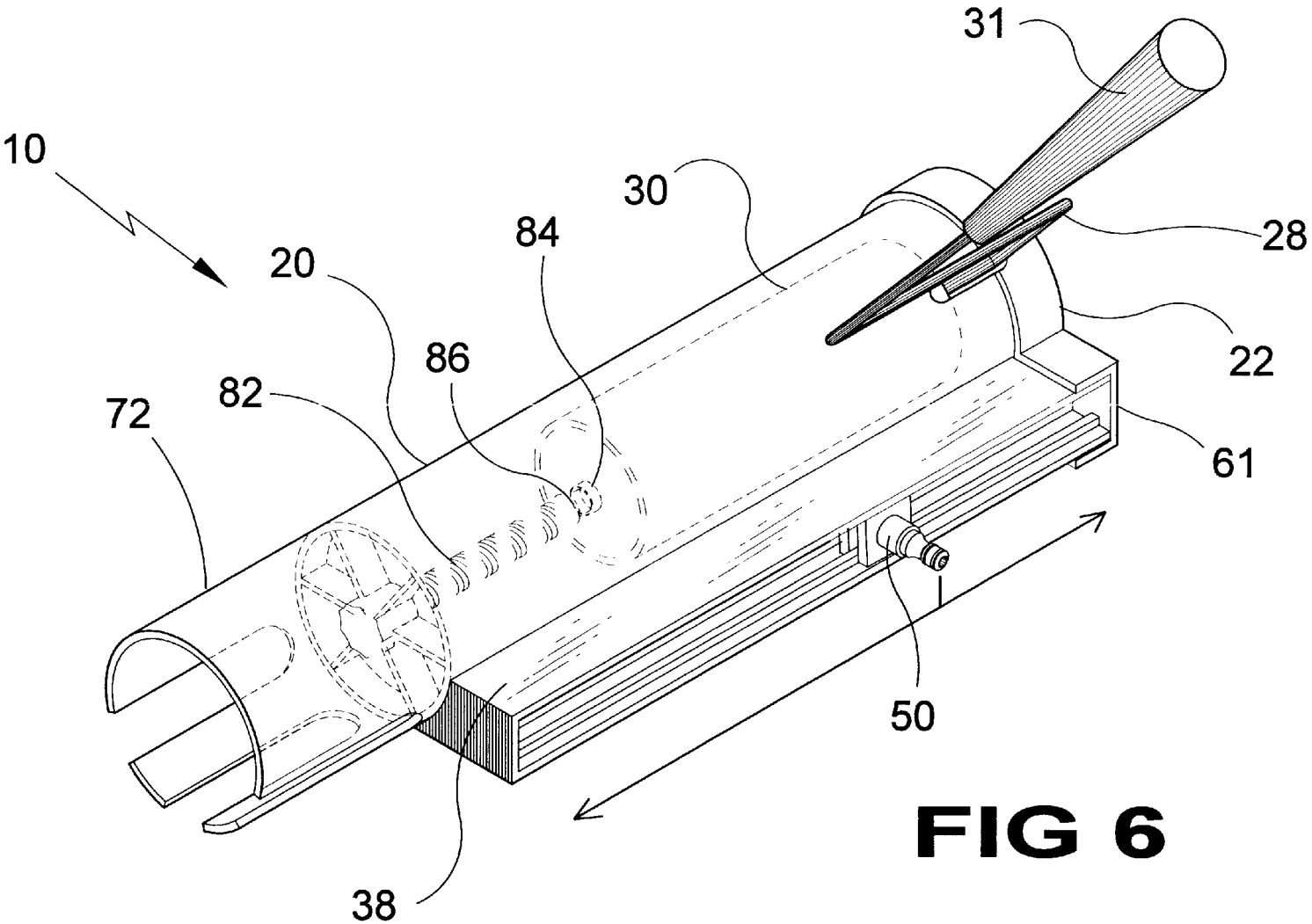
Figure 7:
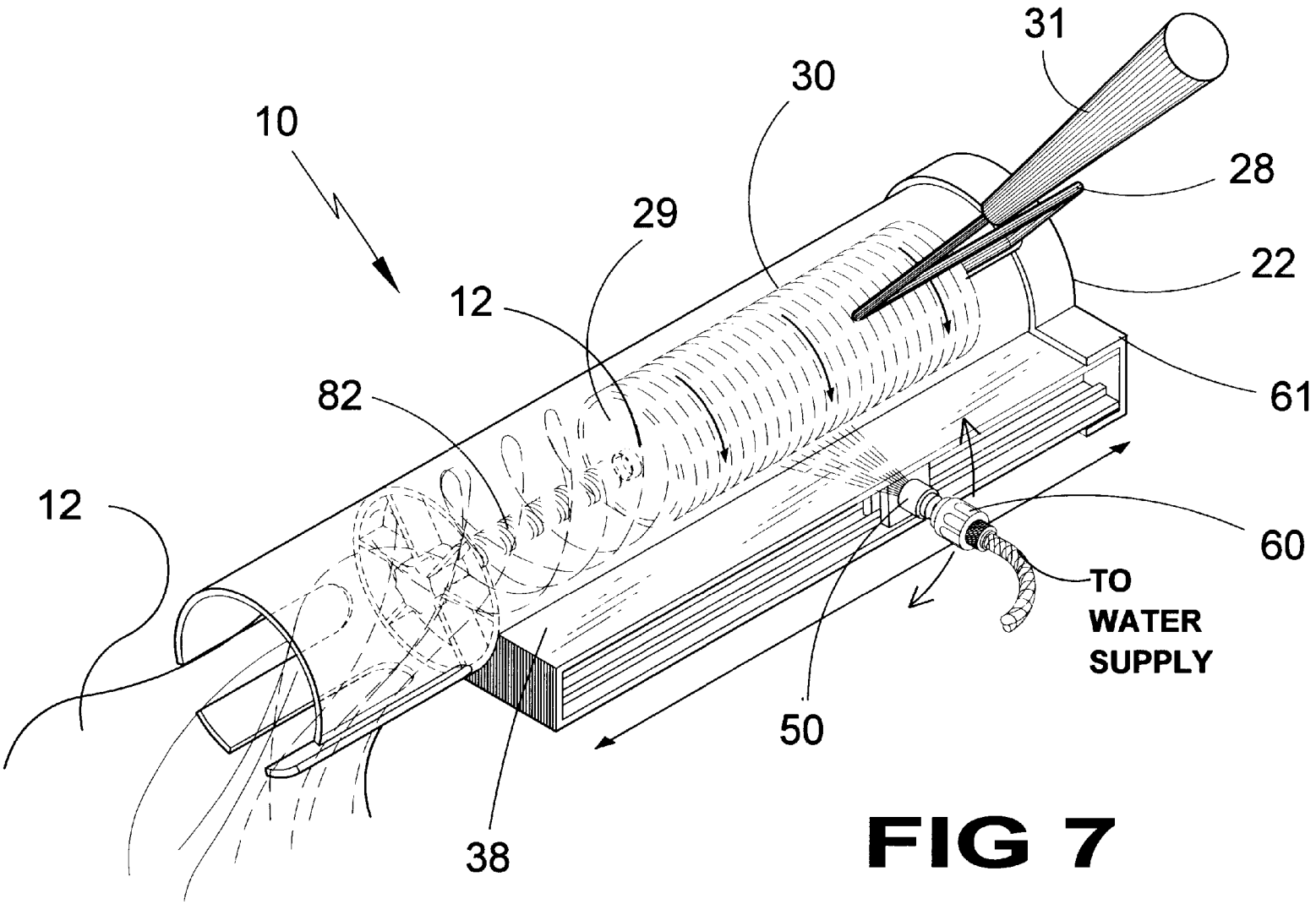

In situations where the paint roller brush mandrel 29 is fixed by means of a fastener (screw/nut) 84, the clamping screw 82, has a receptacle 86 for indexing such a protruding fastener 84, as depicted in FIGS. 5–6. This is accomplished by placing the fixed paint roller assembly into housing member 20 such that the roller frame arm 28 mates with housing member keyway 24 while the paint roller brush mandrel fastener 84 indexes with the clamping screw receptacle 86. Further rotation of the clamping screw 82 assists in securing and positioning the roller brush 30 free for rotation, by working in cooperation with the ridges 32,34 located in end cap 22.

Figure 4:
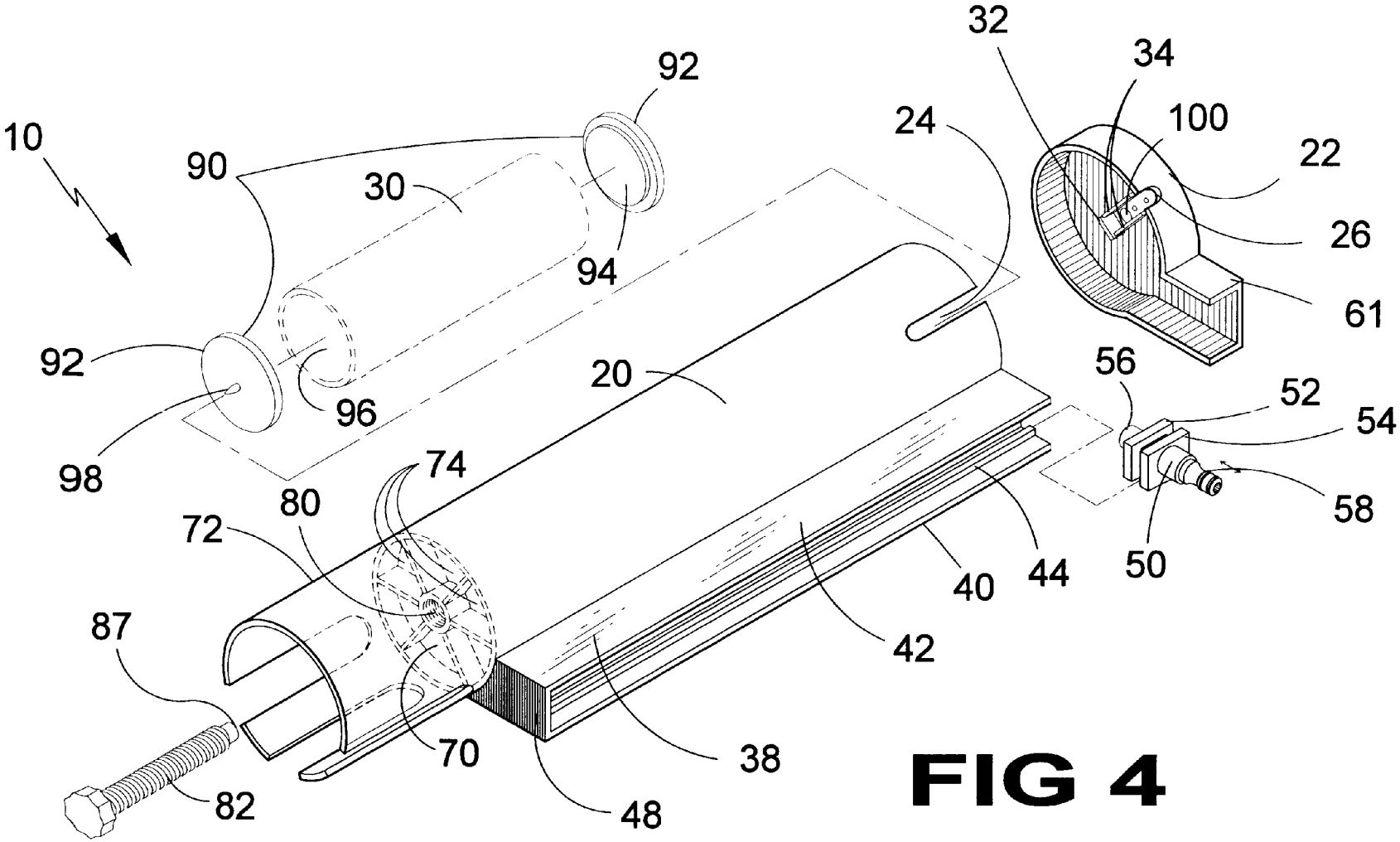

In other situations, it will be desirable to remove the roller brush 30 from the paint roller frame mandrel 29 prior to cleaning. As shown in FIG. 4, two spindle adapters 90 are provided, each with a base 92 having a reduced diameter portion 94, which is closely and securely received by the open ends 96 of the roller brush 30. Each spindle adapter 90 also has a spindle portion 98. To properly utilize the spindle adapters 90, the clamping screw 82 has a spindle bearing recess 87 for rotatably receiving one of such spindle portions 98, while the other spindle portion 98 is rotatably received by the end cap spindle bearing recess 100, positioned centrally in end cap 22. Further rotation of the clamping 82 assists in securing and positioning of the roller brush 30 for free rotation, with limited axial play.

In still other situations, it will be desirable to remove both the paint roller 30 and its integral mandrel 29 from the paint roller frame, prior to cleaning. The two spindle adapters 90, each with a base 92 having a reduced diameters portion 94, are closely and securely received into the open ends (not shown) of the roller brush mandrel 29. To properly utilize the spindle adapters 90, the clamping screw 82 has a spindle bearing recess 87 for rotatably receiving one of such spindle portions 98, while the other spindle portion 98 is rotatably received by the end cap spindle bearing recess 100, positioned centrally in the end cap 22. Further rotation of the clamping screw 82 assists in securing and positioning of the roller brush mandrel 29 for free rotation, with limited axial play.

Fluid moves radially in the housing member 20. As such fluid progresses toward the housing member keyway 24, a deflector 110 extends into the fluid causing a deflection of fluid 12 away from the keyway 24, as depicted in FIGS. 8 and 14. In some embodiments, the deflector 110 is angled to present an obtuse angle to the oncoming fluid. In other embodiments (not shown) the deflector is substantially perpendicular to the housing member 20.

Similarly, as fluid 12 progresses toward the housing member slot 36, a deflector 112 extends into the fluid causing a deflection of fluid 12 away from the housing member slot 36, thus minimizing the amount of fluid 12 splashing from the guiding passage 38. This deflector 112 can also be angled or perpendicular with respect to the housing member 20.

Other deflectors (not shown) can be attached to the housing member 20, in other positions in order to induce turbulent flow.

In other embodiments, adapters (not shown) are provided which prepare typical hose fittings, nozzles and other hose members for attachment within the guiding passage 38. The adapters can have interior features for grasping such members, and exterior features that are similar to the injector assembly flanges 52,54 or the injector assembly curved surface 66, all in accordance with the present invention, and as determined by the intended end use for the overall assembly, as will occur to those of skill in the art upon review of the present disclosure.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder; and (d) a fluid source guide member for receiving and securing the fluid source hose member, the fluid source guide member being positioned adjacent the housing member slot such that the fluid source hose member is slidable along the housing member slot, such movement directing the fluid through the housing member slot and onto the paint roller brush, causing the paint roller brush to rotate on the paint roller frame arm;

(e) said fluid source hose member being of the type having a pair of parallel and opposing flanges, the fluid source guide member further comprising a first and second side, each of the fluid source guide member sides having a ridge, each such ridge being loosely received by the fluid source hose member flanges, such that the fluid source hose member is slidably and rotatably held within the fluid source guide member, causing the angle at which the fluid strikes the paint roller brush to vary.

2. The apparatus of claim 1, wherein the fluid source hose member is rotatable within the fluid source guide member, for varying the angle at which the fluid strikes the paint roller brush.

3. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder, the disc having a threaded bushing;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder;

(d) an injector assembly, for jetting the fluid into the housing member slot, the injector assembly being adapted to receive the fluid source hose member; and (e) a guiding passage for receiving and securing the injector assembly, the guiding passage being positioned adjacent the housing member slot such that the injector assembly is slidable along the housing member slot, such movement directing the fluid through the housing member slot and onto the paint roller brush, causing the paint roller brush to rotate on the paint roller frame arm at variable speed.

4. The apparatus of claim 3, further comprising:

(a) the injector assembly, the injector assembly further comprising a pair of parallel and opposing flanges; and (b) the guiding passage, the guiding passage further comprising a first and second side, each of the guiding passage sides having a ridge, each such ridge being closely received by the injector assembly flanges, such that the injector assembly is slidably held within the guiding passage.

5. The apparatus of claim 4, wherein the guiding passage first and second sides are resilient, such that each bends as the injector assembly is manipulated, for varying the angle at which the fluid strikes the paint roller brush.

6. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the paint roller brush mandrel having a protruding fastener, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder, the disc having a threaded bushing;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder;

(d) a paint roller brush positioning member cooperating with the retaining channel to position and secure the roller brush for rotation in the housing member cylinder, the roller brush positioning member comprising a screw threaded into the disc threaded bushing, the screw having a receptacle in its tip, the screw tip receptacle closely receiving the paint roller brush mandrel fastener as the screw is screwed into the disc threaded bushing; and (e) a fluid source guide member for receiving and securing the fluid source hose member, the fluid source guide member being positioned adjacent the housing member slot such that the fluid source hose member is slidable along the housing member slot such movement directing the fluid through the housing member slot and onto the paint roller brush, causing the paint roller brush to rotate on the paint roller frame arm.

7. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder; and (d) a fluid source guide member for receiving and securing the fluid source hose member, the fluid source hose member being of the type having a pair of parallel and opposing flanges, the fluid source guide member further having a first and second side, each of the fluid source guide member sides having a ridge, each such ridge being loosely received by the fluid source hose member flanges, such that the fluid source hose member is slidably and rotatably held within the fluid source guide member, the fluid source guide member further being positioned adjacent the housing member slot such that the fluid source hose member is slidable along the housing member slot, such movement directing the fluid through the housing member slot and onto the paint roller brush, causing the paint roller brush to rotate on the paint roller frame arm.

8. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder; and (d) a fluid source guide member for receiving and securing the fluid source hose member, the fluid source guide member being positioned adjacent the housing member slot such that the fluid source hose member is slidable along the housing member slot, such movement directing the fluid through the housing member slot and onto the paint roller brush, causing the paint roller brush to rotate on the paint roller frame arm;

(e) a fluid source hose member adapter, the fluid source hose member adapter sealably grasping the fluid source hose member, the fluid source hose member adapter having a pair of parallel and opposing flanges; and (f) the fluid source guide member, the fluid source guide member further comprising a first and second side, each of the fluid source guide member sides having a ridge, each such ridge being loosely received by the fluid source hose member adapter flanges, such that the fluid source hose member is slidably and rotatably held within the fluid source guide member, causing the angle at which the fluid strikes the paint roller brush to vary.

9. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder; and (d) a fluid source guide member for receiving and securing the fluid source hose member, the fluid source guide member being positioned adjacent the housing member slot such that the fluid source hose member is slidable along the housing member slot, such movement directing the fluid through the housing member slot and onto the paint roller brush, causing the paint roller brush to rotate on the paint roller frame arm;

(e) a fluid source hose member adapter, the fluid source hose member adapter sealably grasping the fluid source hose member, the fluid source hose member adapter having a curved surface; and (f) the fluid source guide member, the fluid source guide member further comprising a first and second side, each of the fluid source guide member sides having a curved indention for closely receiving a portion of the fluid source hose member adapter curved surface, such that the fluid source hose member is slidably held within the fluid source guide member, and further such that the fluid source hose member may be rotated within the fluid source guide member, causing the angle at which the fluid strikes the paint roller brush to vary.

10. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder; and (d) a fluid source guide member for receiving and securing the fluid source hose member, the fluid source guide member being positioned adjacent the housing member slot such that the fluid source hose member is slidable along the housing member slot, such movement directing the fluid through the housing member slot and onto the paint roller brush, causing the paint roller brush to rotate on the paint roller frame arm; and (e) a discharge compartment, the discharge compartment being affixed to the housing member, such that fluid discharged through the disc enters the discharge compartment, the discharge compartment further having a top portion and a bottom portion, the discharge compartment bottom portion having a plurality of fluid discharge slots for discharging fluid from the discharge compartment.

11. The apparatus of claim 10, further comprising the disc, the disc being generally circular, the disc having two semicircular portions, the disc having a plurality of apertures, the apertures being located within one of the semicircular portions, such that the fluid is discharged from the housing member cylinder into the discharge compartment top portion, and further such that the fluid is directed along the top portion and then across the bottom portion, such that fluid is discharged through the discharge compartment bottom portion discharge slots.

12. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder;

(d) a fluid source guide member for receiving and securing the fluid source hose member, the fluid source guide member being positioned adjacent the housing member slot such that the fluid source hose member is slidable along the housing member slot, such movement directing the fluid through the housing member slot and onto the paint roller brush, causing the paint roller brush to rotate on the paint roller frame arm;

(e) at least one deflector projecting into the housing member cylinder, such that radially circulating fluid in the housing member cylinder is deflected upon encountering the at least one deflector.

13. The apparatus of claim 12, wherein the at least one deflector projects into the housing member cylinder proximate the housing member slot, such that radially circulating fluid is deflected away from the housing member slot.

14. The apparatus of claim 12, wherein the at least one deflector projects into the housing member proximate the housing member keyway, such that radially circulating fluid is deflected away from the housing member keyway.

15. The apparatus of claim 12, wherein the at least one deflector is substantially perpendicular to the housing member cylinder.

16. The apparatus of claim 12, wherein the at least one deflector is not substantially perpendicular to the housing member cylinder.

17. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder;

(d) a fluid source guide member for receiving and securing the fluid source hose member, the fluid source guide member being positioned adjacent the housing member slot such that the fluid source hose member is slidable along the housing member slot, such movement directing the fluid through the housing member slot and onto the paint roller brush, causing the paint roller brush to rotate on the paint roller frame arm;

(e) an injector assembly for jetting the fluid, the injector assembly being adapted for attachment to the fluid source hose member, the injector assembly being received and secured by the fluid source guide member;

(f) the injector assembly, the injector assembly further comprising a pair of parallel and opposing flanges; and (g) the fluid source guide member, the fluid source guide member further comprising a first and second side, each of the fluid source guide member sides having a ridge, each such ridge being loosely received by a pair of the injector assembly flanges, such that the injector assembly is slidably and rotatably held within the fluid source guide member, causing the angle at which the fluid strikes the paint roller brush to vary.

18. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder;

(d) a fluid source guide member for receiving and securing the fluid source hose member, the fluid source guide member being positioned adjacent the housing member slot such that the fluid source hose member is slidable along the housing member slot, such movement directing the fluid through the housing member slot and onto the paint roller brush, causing the paint roller brush to rotate on the paint roller frame arm;

(e) an injector assembly for jetting the fluid, the injector assembly being adapted for attachment to the fluid source hose member, the injector assembly being received and secured by the fluid source guide member;

(f) the injector assembly, the injector assembly further having a curved surface; and (g) the fluid source guide member, the fluid source guide member further comprising a first and second side, each of the fluid source guide member sides having a curved indention for closely receiving a portion of the injector assembly curved surface, such that the injector assembly is slidably held within the fluid source guide member, and further such that the injector assembly may be rotated within the fluid source guide member, causing the angle at which the fluid strikes the paint roller brush to vary.

19. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder;

(d) a fluid source guide member for receiving and securing the fluid source hose member, the fluid source guide member being positioned adjacent the housing member slot such that the fluid source hose member is slidable along the housing member slot, such movement directing the fluid through the housing member slot and onto the paint roller brush, causing the paint roller brush to rotate on the paint roller frame arm;

(e) an injector assembly for jetting the fluid, the injector assembly being adapted for attachment to the fluid source hose member, the injector assembly being received and secured by the fluid source guide member; and (f) the injector assembly further comprises a valve, such that fluid flow through the injector assembly may be stopped by closing the valve; and (g) the injector assembly valve having a spring loaded actuator, the injector assembly being opened by pushing on the spring loaded injector assembly actuator, and closed by releasing the spring loaded injector assembly actuator.

20. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder;

(d) a fluid source guide member for receiving and securing the fluid source hose member, the fluid source guide member being positioned adjacent the housing member slot such that the fluid source hose member is slidable along the housing member slot, such movement directing the fluid through the housing member slot and onto the paint roller brush, causing the paint roller brush to rotate on the paint roller frame arm;

(e) a pair of spindle adapters, each spindle adapter having a spindle and a base, each spindle base being closely received by an open end on the paint roller brush which has been removed from its mandrel on the paint roller frame;

(f) the closing member having a spindle bearing recess proximate the retaining channel for closely and rotatably receiving one of the spindles;

(g) the disc, the disc having a threaded bushing; and (h) a clamping screw, the clamping screw being threadably received by the disc threaded bushing, the clamping screw further having an end, the clamping screw end having a spindle bearing recess for closely and rotatably receiving one of the spindles, the clamping screw being screwed into such a position that the paint roller brush is securely held for rotation between the closing member spindle bearing recess and the clamping screw spindle bearing recess.

21. The apparatus of claim 20, wherein each spindle adapter base has a plurality of shoulders having decreasing diameters, such that each spindle adapter base is closely receivable by a the open ends of roller brushes having varying diameters.

22. An apparatus for receiving fluid from the hose member of a fluid source to clean a paint roller brush of the type that rotates on a paint roller frame, the paint roller frame having a handle, an arm, and a mandrel rotatably positioned on the arm, the paint roller brush being secured on the mandrel, the apparatus comprising:

(a) a housing member, the housing member having a cylinder, the housing member having a paint roller brush receiving end, for receiving the paint roller brush into the housing member cylinder, the housing member further having a slot for fluid communication into the cylinder, the housing member further having a discharge end for discharging fluid from the housing member cylinder, the housing member further having a keyway, the keyway being adapted to closely receive the paint roller frame arm;

(b) a disc attached to the housing member discharge end, the disc having at least one aperture for allowing fluid to exit the housing member cylinder;

(c) a closing member for opening and closing the housing member receiving end, the closing member having a keyway, the closing member keyway being alignable with the housing member keyway such that the paint roller frame arm is retained when the housing member is closed, the closing member further having a retaining channel, the retaining channel closely receiving the paint roller frame arm, and aligning the paint roller frame arm for roller brush rotation within the housing member cylinder;

(d) a fluid source guide member for receiving and securing the fluid source hose member, the fluid source guide member being positioned adjacent the housing member slot such that the fluid source hose member is slidable along the housing member slot, such movement directing the fluid through the housing member slot and onto the paint roller brush, causing the paint roller brush to rotate on the paint roller frame arm;

(e) a pair of spindle adapters, each spindle adapter having a spindle and a base, each spindle base being closely received by an open end on the paint roller brush mandrel which has been removed from its paint roller frame arm;

(f) the closing member having a spindle bearing recess proximate the retaining channel for closely and rotatably receiving one of the spindles;

(g) the disc, the disc having a threaded bushing; and (h) a clamping screw, the clamping screw being threadably received by the disc threaded bushing, the clamping screw further having an end, the clamping screw end having a spindle bearing recess for closely and rotatably receiving one of the spindles, the clamping screw being screwed into such a position that the paint roller brush is securely held for rotation between the closing member spindle bearing recess and the clamping screw spindle bearing recess.

23. The apparatus of claim 22, wherein each spindle adapter base has a plurality of shoulders having decreasing diameters, such that each spindle adapter base is closely receivable by a the open ends of paint roller brush mandrels having varying diameters.

* * * * *